United States Patent [19]

Richmond

[11] 4,424,906

[45] Jan. 10, 1984

[54] PACKET HOLDER

[75] Inventor: William R. Richmond, Shelbyville, Ind.

[73] Assignee: Williams Industries, Inc., Shelbyville, Ind.

[21] Appl. No.: 376,287

[22] Filed: May 10, 1982

[51] Int. Cl.[3] ..... A47F 5/11

[52] U.S. Cl. ..... 211/50; 206/45.14; 211/73; 248/174

[58] Field of Search ..... 211/73, 72, 50, 104; 248/174, 152; 256/45.14, 469, 491

[56] References Cited

U.S. PATENT DOCUMENTS

| | | | |
|---|---|---|---|
| 1,239,485 | 9/1917 | Heywood | 248/174 |
| 2,971,654 | 2/1961 | Whorton | 211/73 |
| 3,304,042 | 2/1967 | Ivandick | 211/50 X |
| 3,437,193 | 4/1969 | Freeman | 248/152 X |
| 3,718,261 | 2/1973 | Woofter | 211/73 X |
| 3,884,410 | 5/1975 | Gilsicke | 211/50 X |
| 4,300,683 | 11/1981 | Roccaforte | 248/152 X |

*Primary Examiner*—Ramon S. Britts
*Assistant Examiner*—Robert W. Gibson, Jr.
*Attorney, Agent, or Firm*—Barnes & Thornburg

[57] ABSTRACT

A packet holder for holding a plurality of packets of soft drink mix or the like is formed from a longitudinal elongated sheet having three transverse score lines, the sheet being bent along the score lines to form a back element, a bottom element, a front element, and a top element. The top element includes a tongue adapted for engagement with an aperture in the back element and a window for receiving the plurality of packets. The front element may be advantageously used as a convenient display surface to receive advertising or other informative data. The bottom element supports the packets received through the window in the top element. The back element includes an appropriate support or suspension aid.

10 Claims, 3 Drawing Figures

PACKET HOLDER

The present invention is directed to receptacle supports formed from a single cut and scored blank of sheet material, and particularly to such receptacle supports formed of a polymeric resin in planar form. The receptacle support is intended as a general holder for goods and, more specifically, is intended to be used as a holder for packets of soft drink mix or the like, the holder being dimensioned so as to receive a plurality of the packets. The holder is intended to be employed in either a commercial or domestic setting so as to conveniently situate the soft drink packets for easy use of the contents thereof.

The holder generally comprises a longitudinally elongated sheet having at least three transverse score lines, the sheet being bent along the score lines to form a top element, a front element, a bottom element, and a back element. The top element includes a tongue means for engaging the back element to maintain the holder configuration. The top element also includes a window for receiving the goods to be held by the holder. The front element unitarily joins the top element to the bottom element and advantageously provides a display surface for receiving informative data such as commercial advertising or instructions for use of the goods held by the holder.

The bottom element unitarily joins the front element and the back element and further supports a lower portion of goods received in the window of the top element. The back element includes aperture means for receiving the tongue means of the top element, the aperture means including a receiving portion and a locking portion integrally connected to the receiving portion such that the tongue means can be moved from the receiving portion to the locking portion and thereby configure the holder in the preferred orientation.

The tongue means and aperture means are generally dimensioned such that the tongue means can only be inserted in the aperture means as the top element is deformed to a transversely non-planar configuration. The holder is preferably constructed of a polymeric resin in planar form, the resin having sufficient strength and memory to quickly resume its natural planar form when released from a deformed non-planar condition, thereby assuring a locking engagement between the tongue means and aperture means. The preferred polymeric resin is high-density polyethylene having a thickness of approximately 0.090 inch.

The window in the top element preferably occupies a major portion of the area of the top element. The tongue means preferably comprises a first portion, and a second portion unitarily joining the first portion to the remainder of the top element, the second portion having a smaller lateral dimension than the first portion.

The back element aperture means includes a pair of opposed edges separated by a dimension only slightly larger than the lateral extent of the second portion of the tongue means. The locking portion of the aperture means is receivable between the first portion of the tongue means and the remainder of the top element so as to lock the top element to the back element of the holder. The receiving portion of the aperture means preferably also includes a generally arcuate lower edge and notches at the lateral extremities of the lower edge for receiving the widest dimension of the first portion of the tongue means.

These other features of the present invention will become apparent upon consideration of the following discussion of the preferred embodiment exemplifying the best mode of the invention as presently perceived and illustrated in the accompanying figures, in which.

Figure 1:
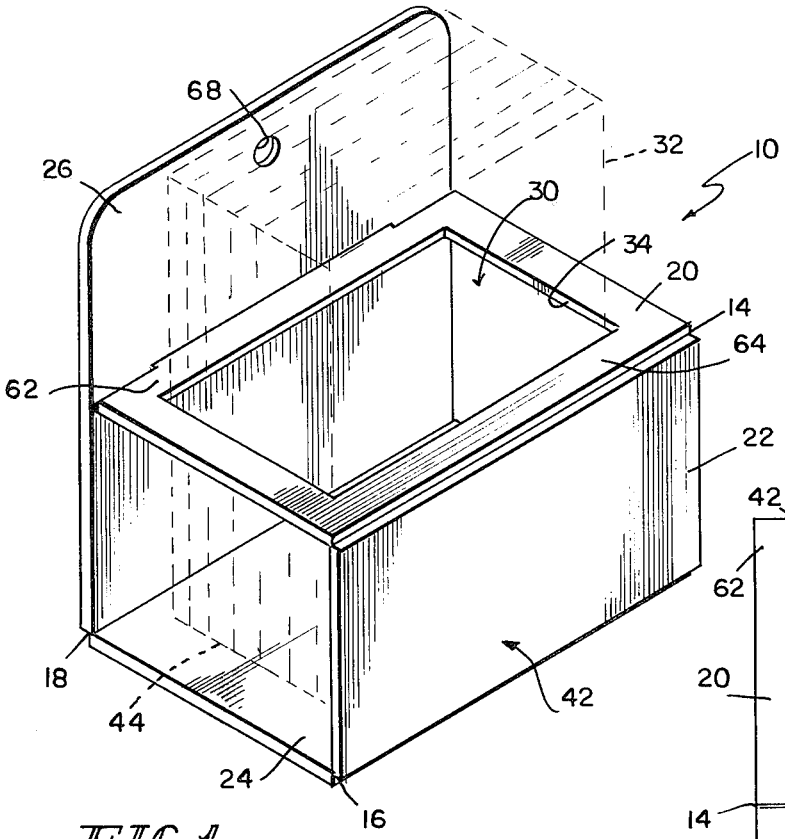
FIG. 1 is a perspective view of the holder configured to its functional orientation.

The holder 10 is formed of a longitudinally elongated sheet 12 as shown in FIG. 12, the sheet 12 having at least three transverse score lines 14, 16, and 18. The sheet 12 is bent along the score lines 14, 16, and 18 to form a top element 20, a front element 22, a bottom element 24, and a back element 26.

The top element 20 includes a tongue means 28 for engaging the top element 20 with the back element 26 to maintain the holder 10 in the preferred configuration illustrated in FIG. 1. A window 30 is provided in the top element 20, the window occupying a major portion, that is, more than 50% of the area of the top element. The window 30 permits the holder 10 to receive goods, in particular packets of soft drink mix 32 shown in phantom in FIG. 1. The window 30 is most conveniently formed with a rectangular edge 34, but may have other shapes of the goods 32 so require.

The tongue means 28 includes a first wider portion 36 having tangs 38 and 40 at the lateral extremities thereof. The tongue means also includes a second portion 42 unitarily joining the first portion 36 to the remainder of the top element 20, the second portion 42 having a smaller lateral dimension than the first portion 36.

The top element 20 is unitarily joined to the bottom element 24 by the front element 22. The front element 22 includes a front display surface 42 on which information or data can be situated.

The bottom element 24, which unitarily joins the front element 22 and the back element 26, supports a lower portion 44 of the goods 32 received in the window 30 of the top element 20.

Figure 3:
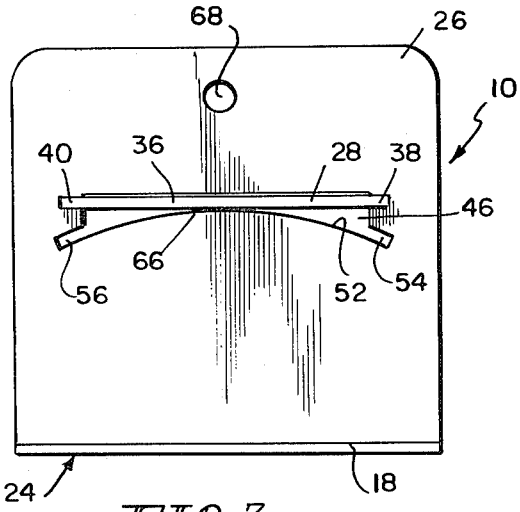
FIG. 3 is an elevation view of the back surface of the holder with the tongue means extending through the aperture means of the back element.

The back element 26 includes means 68 for suspending the holder and an aperture means 46 which includes a receiving portion 48 and a locking portion 50 integrally connected to the receiving portion 48. The receiving portion 48 of aperture means 46 and the tongue means 28 are dimensioned such that the tongue means 28 can only be inserted in the aperture means 46 as the top element 20 is deformed to a transversely non-planar configuration. This transversely non-planar configuration is seen in FIG. 3 to be downwardly concave. This downward concavity is achieved by providing a lower edge 52 and notches 54 and 56 for receiving the widest dimension of the tangs 38 and 40 of the tongue means 28, respectively.

The locking portion 50 of the aperture 46 includes a pair of opposed edges 58 and 60 separated by a dimension only slightly larger than the lateral extent of the second portion 42 of the tongue means 28. The opposed edges 58 and 60 are receivable between the first portion 38 of the tongue means 28 and the remainder of the top element 20 in notches defining the more narrow second portion 42 of tongue means 28.

While the selection of materials for forming a holder of the present invention is not critical, it is important that the material be sufficiently flexible and that the portion 62 of top element 20 nearest the tongue means 28 be deformable while portion 64 adjacent crease 14 remains substantially planar. The material should also have sufficient memory that when portion 62 is released from the outside pressure necessary to bend portion 62 into the arcuate curve so that tongue means 28 can be received in aperture means 46, the portion 62 will resume its natural planar configuration, thereby firmly locking top element 20 to back element 26. The central portion 66 of edge 52 ensures that the tongue means 28 will be held in locking engagement in the aperture means 46 so long as portion 62 is not deformed from its planar configuration.

Figure 2:
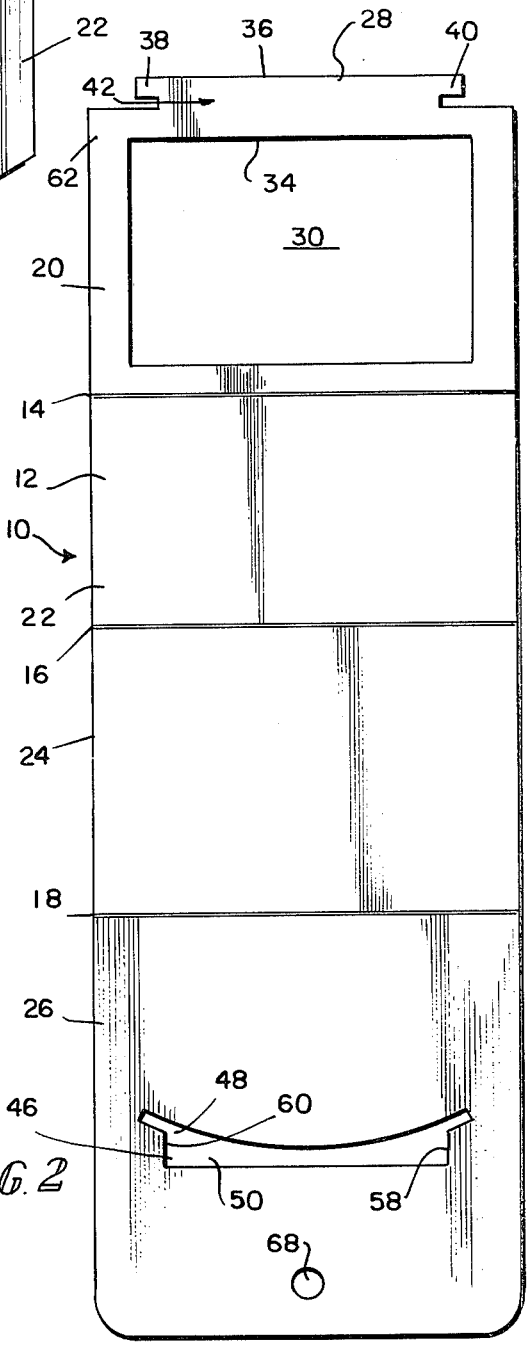
FIG. 2 is a plan view of the holder in planar configuration.

While some variations and modifications of the present invention will be apparent to those skilled in the art, the invention includes embodiments other than the specifically preferred embodiment illustrated in FIGS. 1–3 and encompassses that defined in the following claims.

What is claimed is:

1. A holder for goods, comprising a longitudinally elongated sheet having at least three transverse score lines, the sheet being bent along these score lines to form a top element, a front element, a bottom element, and a back element, the top element including tongue means for engaging the back element to maintain holder configuration and a window for receiving goods, the front element unitarily joining the top element and the bottom element, the bottom element unitarily joining the front element and the back element and supporting a lower portion of goods received in the window in the top element, and the back element including a aperture means for receiving the tongue means of the top element, the aperture means including a receiving portion and a locking portion integrally connected to the receiving portion the receiving portion including an arcuate edge and notches at the lateral extremities of the arcuate edged for receiving the widest dimension of the tongue means.

2. The holder of claim 1 wherein the tongue means and the aperture means are dimensioned such that the tongue means can only be inserted in the aperture means as the top element is deformed to a transversely non-planar configuration.

3. The holder of claim 2 wherein the holder is constructed of a polymeric resin in planar form, the resin having sufficient strength and memory to quickly resume said planar form when released from a deformed non-planar condition.

4. The holder of claim 3 wherein the holder is constructed of high-density polyethylene of approximately 0.090 inch thickness.

5. The holder of claim 1 wherein the back element further includes means for suspending the holder.

6. The holder of claim 1 wherein the front element includes a display surface for receiving informative data.

7. The holder of claim 1 wherein the window in the top element comprises a major portion of the area of the top element.

8. The holder of claim 1 wherein the tongue means comprises a first portion, and a second portion unitarily joining the first portion to the remainder of the top element, the second portion having a smaller lateral dimension than the first portion.

9. The holder of claim 8 wherein the locking portion of the aperture means includes a pair of opposed edges separated by a dimension only slightly larger than the lateral extent of said second portion of the tongue means, the opposed edges being receivable between the first portion of the tongue means and the remainder of the top element.

10. A holder for goods, comprising a longitudinally elongated sheet having at least three transverse score lines, the sheet being bent along these score lines to form a top element, a front element, a bottom element, and a back element, the top element including tongue means for engaging the back element to maintain holder configuration and a window for receiving goods, the tongue means including a first portion, and a second portion unitarily joining the first portion to the remainder of the top element, the second portion having a smaller lateral dimension that the first portion, the front element unitarily joining the top element and the bottom element, the bottom element unitarily joinging the front element and the back element and supporting a lower portion of goods received in the window in the top element, and the back element including a aperture means for receiving the tongue means of the top element, the aperture means including a receiving portion and a locking portion integrally connected to the receiving portion, the locking portion of the aperture means including a pair of opposed edges separated by a dimension only slightly larger than the lateral extent of said second portion of the tongue means, the opposed edges being receivable between the first portion of the tongue means and the remainder of the top element, the receiving portion of the aperture means including an arcuate lower edge and notches at the lateral extremities of the lower edge for receiving the widest dimension of the first portion of the tongue means.

* * * * *